US009164463B2

(12) United States Patent
Masuta

(10) Patent No.: US 9,164,463 B2
(45) Date of Patent: Oct. 20, 2015

(54) IMAGE FORMING APPARATUS INCLUDING PLURALITY OF PAPER OUTPUT TRAYS

(71) Applicant: Kyocera Document Solutions Inc., Osaka (JP)

(72) Inventor: Noriko Masuta, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 21 days.

(21) Appl. No.: 13/951,114

(22) Filed: Jul. 25, 2013

(65) Prior Publication Data

US 2014/0029999 A1 Jan. 30, 2014

(30) Foreign Application Priority Data

Jul. 30, 2012 (JP) ..... 2012-167909

(51) Int. Cl.

| | |
|---|---|
| ***B41J 29/377*** | (2006.01) |
| ***B65H 31/24*** | (2006.01) |
| ***G03G 15/00*** | (2006.01) |
| ***G03G 21/06*** | (2006.01) |
| *G03G 21/20* | (2006.01) |

(52) U.S. Cl.

CPC ..... *G03G 15/6552* (2013.01); *B41J 29/377* (2013.01); *G03G 21/06* (2013.01); *B65H 31/24* (2013.01); *B65H 2301/5144* (2013.01); *G03G 21/206* (2013.01)

(58) Field of Classification Search

CPC ..... B65H 31/24; B65H 2301/5144; B65H 29/377; G03G 21/06

USPC ..... 399/405; 400/646

See application file for complete search history.

(56) References Cited

U.S. PATENT DOCUMENTS

| | | | | |
|---|---|---|---|---|
| 6,522,841 | B2 * | 2/2003 | Horikoshi | 399/45 |
| 8,045,914 | B2 * | 10/2011 | Kato et al. | 399/405 |
| 8,139,995 | B1 * | 3/2012 | Fujita et al. | 399/390 |
| 2007/0139731 | A1 | 6/2007 | Saito | |
| 2008/0044213 | A1 * | 2/2008 | Kato et al. | 399/405 |
| 2012/0093555 | A1 * | 4/2012 | Obuchi | 399/405 |

FOREIGN PATENT DOCUMENTS

| | | |
|---|---|---|
| JP | 2011-107531 | 6/2011 |

* cited by examiner

*Primary Examiner* — Daniel J Colilla
*Assistant Examiner* — John M Royston
(74) *Attorney, Agent, or Firm* — K&L Gates LLP

(57) ABSTRACT

An image forming apparatus includes an image forming portion, a first paper output tray, and a second paper output tray. The image forming portion forms toner images and fixes toner images on sheets. The first paper output tray includes a first receiving portion positioned on its upper surface and configured to receive a sheet with a fixed toner image thereon. The second paper output tray is positioned over the first receiving portion. The second paper output tray includes a second receiving portion positioned on its upper surface and configured to receive a sheet thereon. The second paper output tray includes an accommodation space therein. The accommodation space accommodates cooling air for cooling the sheets.

4 Claims, 6 Drawing Sheets

IMAGE FORMING APPARATUS INCLUDING PLURALITY OF PAPER OUTPUT TRAYS

INCORPORATION BY REFERENCE

This application is based upon, and claims the benefit of priority from, corresponding Japanese Patent Application No. 2012-167909, filed on Jul. 30, 2012, the entire contents of which are incorporated herein by reference.

BACKGROUND

Unless otherwise indicated herein, the description in this section is not prior art to the claims in this application and is not admitted to be prior art by inclusion in this section.

A typical electrophotographic image forming apparatus, such as a printer, a copier, or a facsimile machine, and a multifunction peripheral, includes a fixing portion that heats and presses a toner image, fixing onto a sheet, and a plurality of paper output trays configured to receive the resultant sheet.

In such an image forming apparatus, the sheet is heated when the toner image is fixed by the fixing portion, and the heated sheet is placed on one of the paper output trays. This causes a problem in that the toner on one sheet is removed by being attached to the back side of another sheet. When a toner container is placed below the paper output tray, a problem arises in that the heat of the sheets in the paper output tray is conveyed to the toner container through the paper output tray, toner in the toner container becomes hot and fuses.

To address this problem, an image forming apparatus may include an exhaust fan on an end in a direction perpendicular to the sheet ejection direction. The exhaust fan sucks air heated by the sheets that eject onto the paper output tray.

However, a substrate or other components are often positioned on the end in the direction perpendicular to the sheet ejection direction, and it is difficult to provide space to accommodate the exhaust fan. Because the amount of airflow is small in locations distant from the exhaust fan, it is difficult to sufficiently increase the efficiency of cooling the sheets.

SUMMARY

An image forming apparatus according to an embodiment of the present disclosure includes an image forming portion, a first paper output tray, and a second paper output tray. The image forming portion forms toner images and fixes toner images on sheets. The first paper output tray includes a first receiving portion positioned on its upper surface and configured to receive a sheet with a fixed toner image thereon. The second paper output tray is positioned over the first receiving portion. The second paper output tray includes a second receiving portion positioned on its upper surface and configured to receive a sheet thereon. The second paper output tray includes an accommodation space therein. The accommodation space accommodates cooling air for cooling the sheets.

Additional features and advantages are described herein, and will be apparent from the following Detailed Description and the figures.

DETAILED DESCRIPTION

Figure 1:
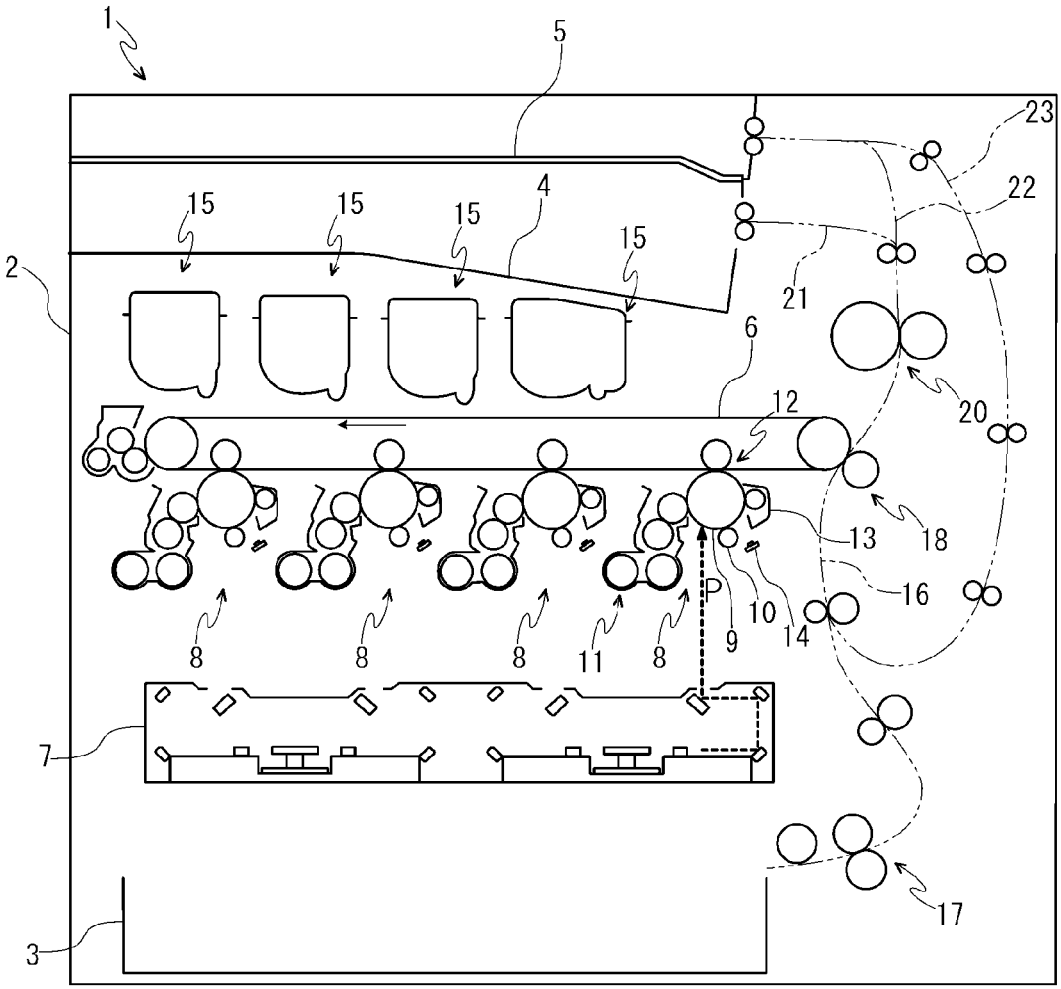
FIG. 1 is a diagram that schematically illustrates the configuration of a color printer according to an embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

First, the configuration of a color printer 1 as an image forming apparatus according to an embodiment of the present disclosure will be generally described. FIG. 1 is a diagram that schematically illustrates the configuration of the color printer 1 according to an embodiment of the present disclosure.

The color printer 1 includes a box-shaped printer main body 2. A paper feed cassette 3 holding sheets (not illustrated) is positioned in the lower part of the printer main body 2. A first paper output tray 4 is positioned in the upper part of the printer main body 2. A second paper output tray 5 is positioned above the first paper output tray 4. In an embodiment, the first paper output tray 4 and the second paper output tray 5 form a two-tiered arrangement.

An intermediate transfer belt 6, as an image bearing member, is placed around a plurality of rollers inside the printer main body 2. An exposure device 7 including a laser scanning unit (LSU) is located below the intermediate transfer belt 6. Four image forming portions 8 are disposed along the lower part of the intermediate transfer belt 6. The image forming portions 8 correspond to toner colors (e.g., four colors of magenta, cyan, yellow, and black).

Each of the image forming portions 8 includes a rotatable photosensitive drum 9 and further includes a charger 10, a developing device 11, a primary transfer portion 12, a cleaning device 13, and a charge eliminating device 14, which are located around the photosensitive drum 9 in sequence of a primary transferring process. Four toner containers 15 are positioned above the developing devices 11. The containers 15 hold respective toners corresponding to the colors of the image forming portions 8.

A transport path 16 is located in a first side (right part in FIG. 1) of the printer main body 2. A paper feed portion 17 is located at the upstream end of the transport path 16. A secondary transfer portion 18 is located on one end (right end in FIG. 1) of the intermediate transfer belt 6 in the middle part of the transport path 16. A fixing portion 20 is located in the downstream part of the transport path 16.

The transport path 16 is split into a lower branch route 21 and an upper branch route 22 in the part downstream of the fixing portion 20. The upper branch route 22 is connected to the part of the transport path 16 upstream of the secondary transfer portion 18 through a reversing path 23 for use in duplex printing disposed in a first part (right part in FIG. 1) of the transport path 16.

Next, an image forming operation of the color printer 1 having the above-described configuration will be described. When the power to the color printer 1 is turned on, various parameters are initialized, and the initial settings, including the temperature setting of the fixing portion 20, are made. Then, when image data is inputted from a computer or the like connected to the color printer 1 and an instruction to start printing is provided, the image forming operation is executed as described below.

First, after the surface of the photosensitive drum 9 is charged by the charger 10, the photosensitive drum 9 is exposed to a laser beam (see the arrow P) from the exposure device 7 in accordance with the image data, and an electrostatic latent image is formed on the surface of the photosensitive drum 9. Then, the electrostatic latent image is developed to a toner image of the corresponding color by the developing device 11 using the toner supplied from the container 15. The toner image is primarily transferred to the surface of the intermediate transfer belt 6 at the primary transfer portion 12. This operation is repeated by each of the image forming portions 8, thus forming a full-color toner image on the intermediate transfer belt 6. The toner and charges remaining on the photosensitive drum 9 are removed by the cleaning device 13 and the charge eliminating device 14.

A sheet pulled from the paper feed cassette 3 or a manual feed tray (not illustrated) by the paper feed portion 17 is transported to the secondary transfer portion 18 at a timing matching the above-described image forming operation. The sheet is subjected to secondary transferring of the full-color toner image on the intermediate transfer belt 6 at the secondary transfer portion 18. The sheet with the toner image, secondarily transferred thereon, is transported toward the downstream side along the transport path 16 and enters the fixing portion 20. The toner image is fixed on the sheet at the fixing portion 20. The sheet with the fixed toner image enters either the lower branch route 21 or the upper branch route 22. When the sheet enters the lower branch route 21, it is ejected to the first paper output tray 4. In contrast, when the sheet enters the upper branch route 22, it is ejected to the second paper output tray 5 or transported to the reversing path 23 for duplex printing. That is, the color printer 1 in an embodiment is configured such that the sheet with the fixed toner image is selectively ejected to the first paper output tray 4 or the second paper output tray 5.

Next, the upper part of the printer main body 2 will be described in detail with reference to FIGS. 2 to 4.

First, the first paper output tray 4 and its surroundings are described. As illustrated in FIG. 2, the first paper output tray 4 is positioned over the containers 15. The above-described fixing portion 20 is positioned in the vicinity of the first paper output tray 4 (right part in the present embodiment). The fixing portion 20 may include a heating roller 24, a pressure roller 25 to the right of the heating roller 24, and an induction heating (IH) coil unit 26 to the left of the heating roller 24. The pressure roller 25 is pressed in contact with the heating roller 24 by the urging force of urging member (not illustrated). A fixing nip 27 is formed between the heating roller 24 and the pressure roller 25. The pressure roller 25 is rotated by following the rotation of the heating roller 24. The sheet transported along the transport path 16 is heated and pressed at the fixing nip 27, thereby fixing the toner image on the sheet.

A first receiving portion 28 for receiving sheets thereon is formed on the upper surface of the first paper output tray 4. A base 30 having a quadrangular prism shape is positioned on the left end side of the first paper output tray 4. A first paper output unit 31 is positioned above the right end of the first paper output tray 4. The first paper output unit 31 includes a driving roller 32 and a driven roller 33 arranged above the driving roller 32. The driving roller 32 is connected to a driving source (not illustrated) through a plurality of gears (not illustrated) and is configured to be rotated by the driving force from the driving source. The driven roller 33 is pressed in contact with the driving roller 32 and is rotated by following the rotation of the driving roller 32. The rotation of the driving roller 32 and the driven roller 33 enables the sheet transported along the lower branch route 21 to be ejected to the first paper output tray 4 through a paper ejection port 39. The first paper output unit 31 is not illustrated in FIG. 3.

Next, the second paper output tray 5 and its surroundings will be described.

Figure 2:
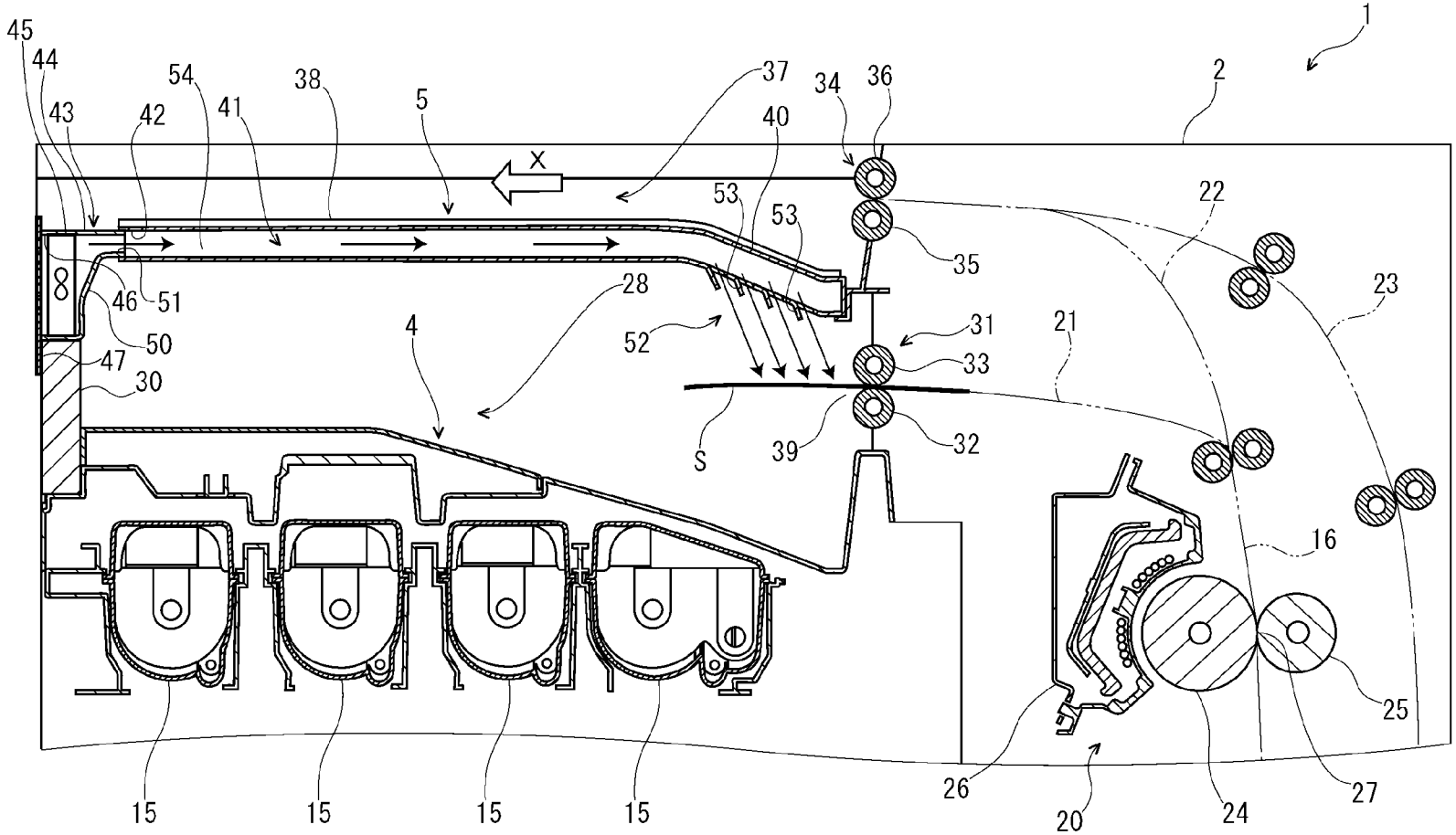
FIG. 2 is a cross-sectional view that illustrates the upper part of the color printer according to an embodiment of the present disclosure.

As illustrated in FIG. 2, a second paper output unit 34 is positioned above the right end of the second paper output tray 5. The second paper output unit 34 includes a driving roller 35 and a driven roller 36 arranged above the driving roller 35. The second paper output unit 34 has substantially the same configuration as that of the first paper output unit 31, and the description thereof is omitted. The second paper output unit 34 is not illustrated in FIG. 3.

Figure 3:
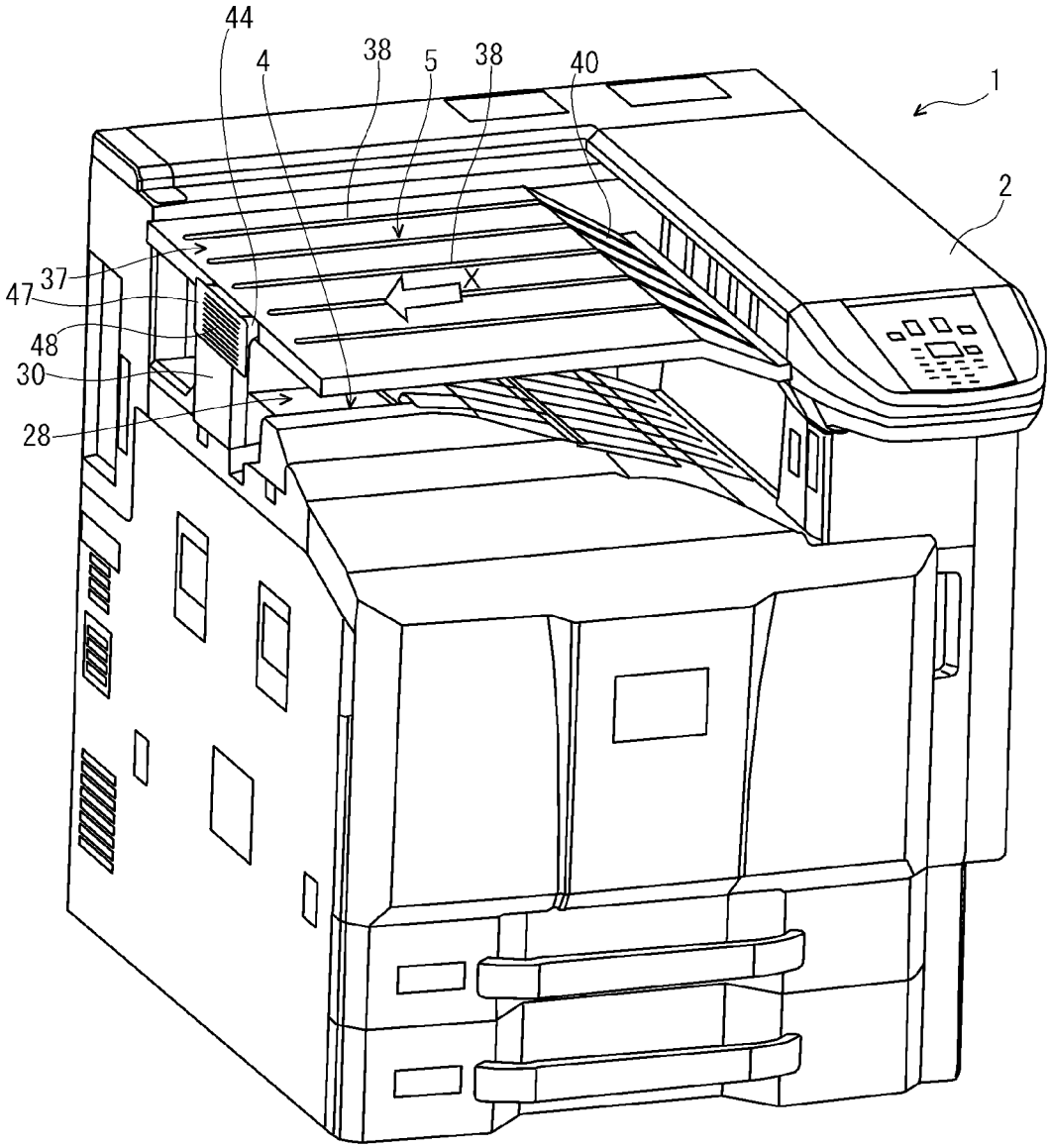
FIG. 3 is a perspective view that illustrates the color printer according to an embodiment of the present disclosure.

As illustrated in FIG. 3, the second paper output tray 5 is positioned over the first receiving portion 28. A second receiving portion 37 for receiving sheets thereon is positioned on the upper surface of the second paper output tray 5. The second paper output tray 5 is provided with a plurality of linear ribs 38 on its upper surface. The ribs extend along the sheet ejection direction (direction from the right side toward the left side in the present embodiment; see the arrows X in FIGS. 2 and 3) from the second paper output unit 34 (see FIG. 2).

Figure 4:
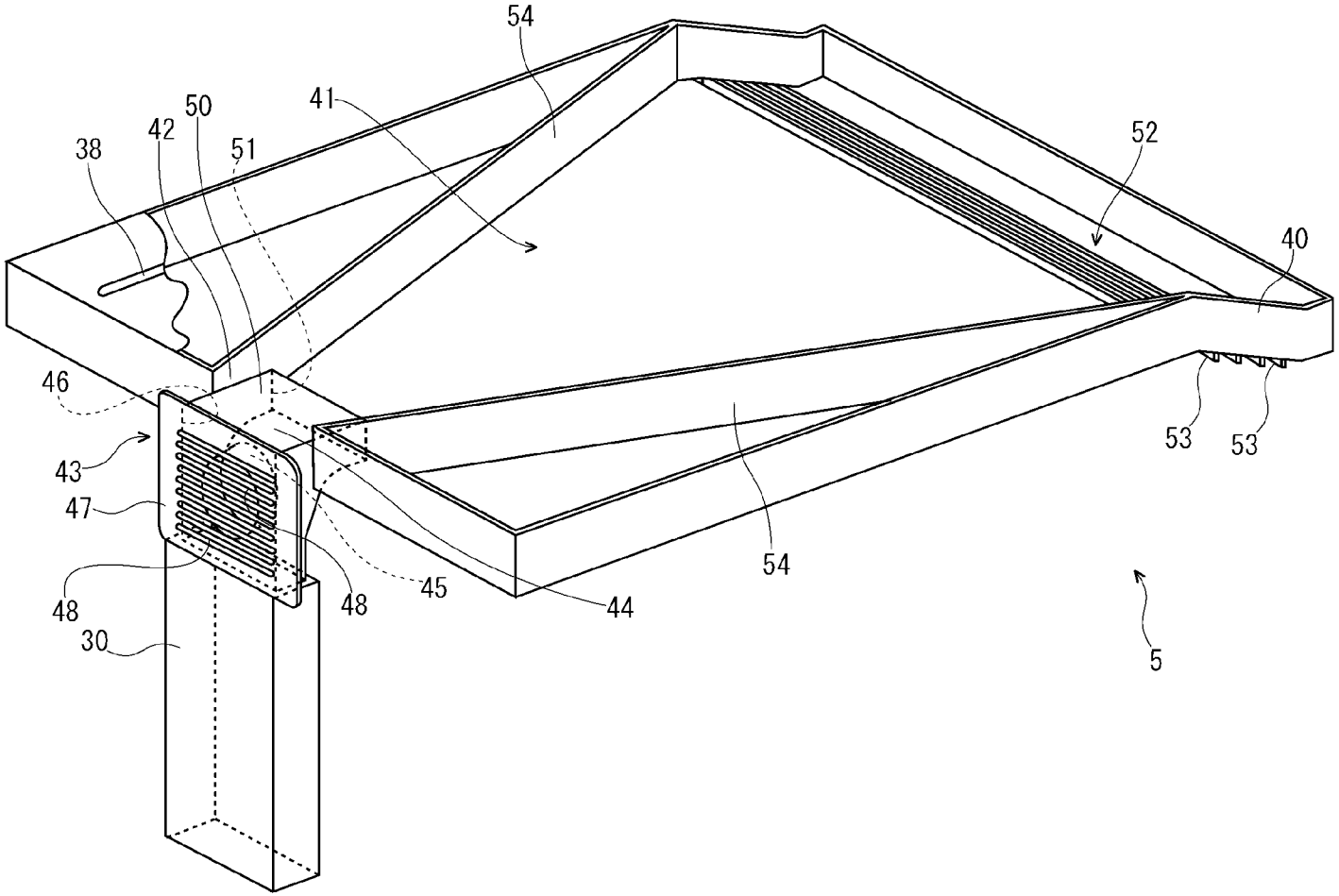
FIG. 4 is a perspective view that illustrates a base, an air-blowing device, and a second paper output tray in the color printer according to an embodiment of the present disclosure.

As illustrated in FIG. 4, the second paper output tray 5 has a flat box shape having longer sides extending the right and left direction. An inclined portion 40 inclined rightward is positioned on the right end side of the second paper output tray 5. Of the upper plate of the second paper output tray 5, only part at its left rear corner is illustrated in FIG. 4 to show the inside of the second paper output tray 5 in an easy-to-understand way.

The second paper output tray 5 includes an accommodation space 41 therein. The accommodation space 41 accommodates cooling air for cooling sheets. An inlet 42 for receiving the cooling air is positioned in the left end part of the accommodation space 41. As illustrated in FIG. 2, the inlet 42 is positioned at the end on the side remote from the fixing portion 20 in the accommodation space 41. The inlet 42 is positioned at the end on the side remote from the paper output units 31 and 34 in the accommodation space 41. The inlet 42 is arranged on the downstream end side in the paper ejection direction (see the arrows X in FIGS. 2 and 3).

The inlet 42 is connected to an air-blowing device 43. The air-blowing device 43 includes a casing 44 secured on the upper surface of the base 30 and a fan 45 accommodated in the casing 44. An intake air opening 46 is positioned on the left side surface of the casing 44. An intake air plate 47 is attached so as to cover the intake air opening 46. As illustrated in FIG. 4, the intake air plate 47 has a substantially rectangular shape.

The intake air plate 47 has a plurality of horizontally extending intake air slits 48 arranged vertically at intervals. A tapered air-blowing duct 50 is positioned on the right side of the casing 44. A blow-off port 51 is positioned on a tip (right end) of the air-blowing duct 50. The air-blowing duct 50 is positioned in the inlet 42 of the accommodation space 41 in the second paper output tray 5.

An outlet 52 for discharging cooling air from the accommodation space 41 is positioned in the right end side part of the accommodation space 41. The outlet 52 is positioned in the part near the first paper output unit 31 in the accommodation space 41. The outlet 52 is open in the bottom of the inclined portion 40 in the second paper output tray 5. The outlet 52 is arranged on the upstream end side in the sheet ejection direction (see the arrows X in FIGS. 2 and 3). A plurality of guiding plates 53 are positioned in the outlet 52 and horizontally arranged at intervals. Each of the guiding plates 53 has a long strip shape and is longer in the front and rear direction. As illustrated in FIG. 2, the guiding plates 53 project toward the first paper output unit 31 (lower right side in the present embodiment).

As illustrated in FIG. 4, the accommodation space 41 is formed between a pair of front and rear partitions 54 disposed on the second paper output tray 5. The pair of front and rear partitions 54 are arranged in a substantially V shape such that the gap between the opposing partitions 54 gradually increases toward the right. Thus, the width in the front and rear direction of the accommodation space 41 gradually increases from the inlet 42 toward the outlet 52.

When the image forming operation on a sheet starts in the above-described configuration, the fan 45 in the air-blowing device 43 is activated. When the fan 45 is activated, cooling air is introduced into the casing 44 through the intake air slits 48 in the intake air plate 47. The cooling air is blown through the blow-off port 51 of the casing 44, as illustrated in FIG. 2, and is received in the accommodation space 41 through the inlet 42. The cooling air received in the accommodation space 41 is sent toward the outlet 52 side in the accommodation space 41 and is then discharged through the outlet 52. The direction of the cooling air discharged through the outlet 52 is changed by the guiding plates 53 in the outlet 52. The cooling air is discharged toward the paper ejection port 39 and is directly blown to a sheet S ejected from the first paper output unit 31. Thus, the sheet S is effectively cooled before being ejected to the first paper output tray 4.

In addition, a sheet ejected to the first paper output tray 4 and received on the first receiving portion 28 and a sheet ejected to the second paper output tray 5 and received on the second receiving portion 37 are cooled by the second paper output tray 5, which has been cooled by the cooling air. This can suppress defects of removal of toner from the sheets on the first receiving portion 28 and the second receiving portion 37. Cooling the sheet on the first receiving portion 28 can prevent unused toner, in each of the containers 15, from being fused by heat conveyed from that sheet to the container 15 through the first paper output tray 4. The inclusion of the accommodation space 41 for use in moving the cooling air in the second paper output tray 5 can suppress leakage or dispersion of the cooling air, and the efficiency of the cooling of the sheets can be increased.

The vicinity of the first paper output unit 31 (right to the printer main body 2) is relatively dense with the components. In an embodiment, the air-blowing device 43 is positioned on the relatively large side opposite to the first paper output unit 31 (left to the printer main body 2). Thus the space for positioning the air-blowing device 43 can be easily provided, and miniaturization of the apparatus can also be supported.

The distance between the uppermost sheet among the sheets on the first paper output tray 4 and the second paper output tray 5 reduces with an increase in the amount of sheets on the first paper output tray 4. Thus the efficiency of the cooling of the sheets by the second paper output tray 5 can be improved in accordance with an increase in the amount of sheets on the first paper output tray 4.

When the image forming operation on the sheet is completed, the fan 45 is stopped. The fan 45 can be activated and stopped in synchronization with, for example, activating and stopping another fan (not illustrated), such as a fan for cooling the fixing portion 20.

Figure 6:
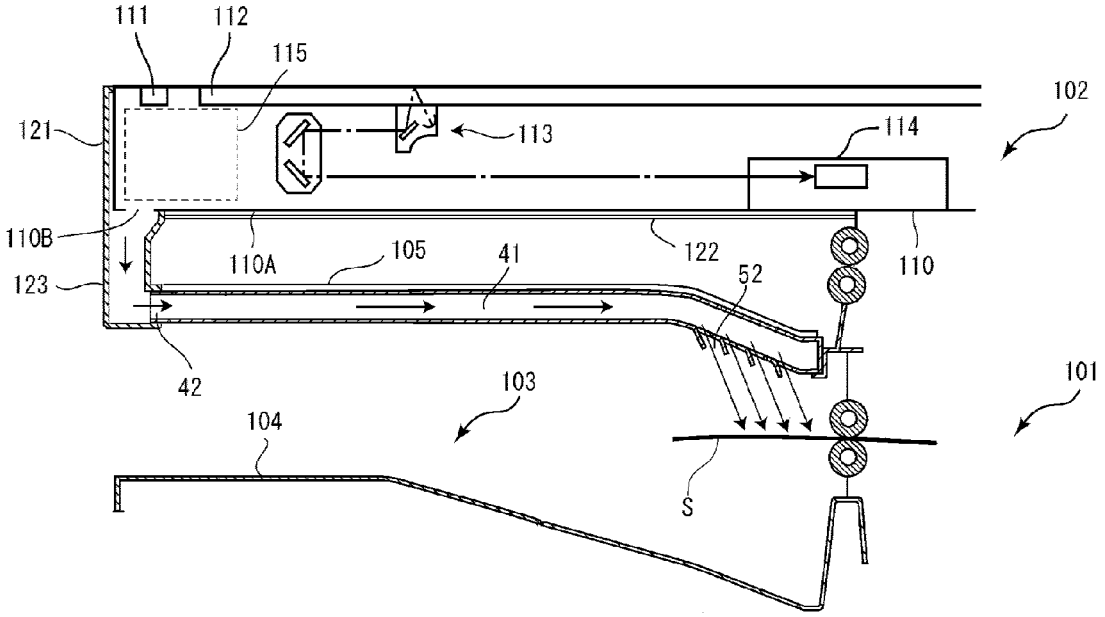
FIG. 6 is a cross-sectional view that illustrates the upper part of the color copier according to the embodiment of FIG. 5.
Figure 7:
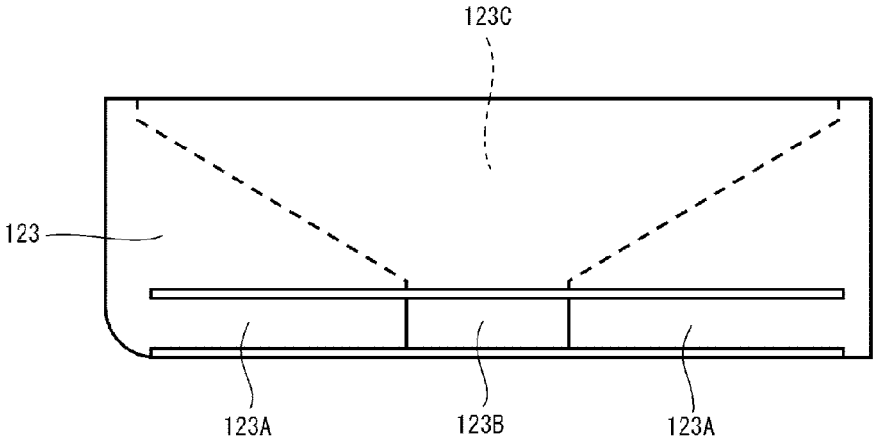
FIG. 7 is a plan view of a guiding portion of the color copier viewed from a cavity paper output portion in the color copier according to an embodiment of the present disclosure.

A color copier 100 as an image forming apparatus according to another embodiment of the present disclosure will be described with reference to FIGS. 5 to 7.

Figure 5:
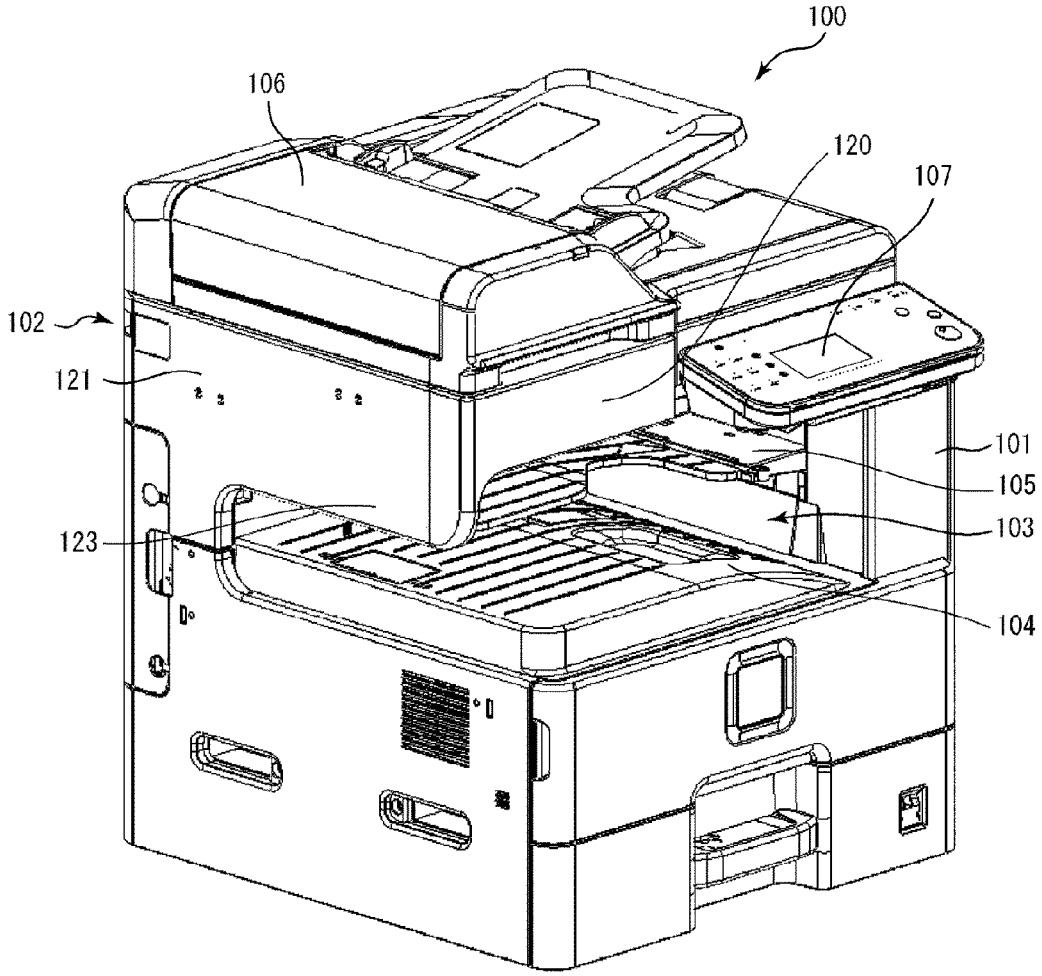
FIG. 5 is a perspective view that illustrates a color copier according to another embodiment of the present disclosure.

FIG. 5 is a perspective view that illustrates the color copier according to an embodiment of the present disclosure. FIG. 6 is a cross-sectional view that illustrates the upper part of the color copier according to this embodiment of the present disclosure. FIG. 7 is a plan view of a guiding portion of the color copier viewed from a cavity paper output portion in the color copier according to an embodiment of the present disclosure.

The color copier 100 includes an image reading portion 102 having a substantially rectangular parallelepiped shape located above a copier main body 101. The copier main body 101 accommodates various devices for forming images. The image reading portion 102 accommodates various devices for optically reading images on documents. The cavity space surrounded by the copier main body 101 and the image reading portion 102 is a cavity paper output portion 103 capable of storing sheets with images formed thereon. A first ejection tray 104 and a second ejection tray 105 are located in the cavity paper output portion 103. A document conveying device 106 is positioned on the upper part of the image reading portion 102.

The first ejection tray 104 is open in the front surface and the left side surface of the copier main body 101. The second ejection tray 105 is open in the front surface of the copier main body 101. Users can insert their hands through these open areas and take sheets with images formed thereon from the cavity paper output portion 103. The configuration of the copier main body 101 and the operation of ejecting sheets with images formed thereon to the first ejection tray 104 or the second ejection tray 105 are substantially the same as the configuration and the operation of the corresponding components in the color printer 1 in the first embodiment, and the description thereof is omitted.

An operating panel unit 107 projects from the front surface of the image reading portion 102. The operating panel unit 107 includes operational keys, including a numeric keypad and a start key, and a liquid crystal display (LCD) touch panel and can accept inputs of instructions of various operations from users. The image reading portion 102 includes a reading frame 110 having a substantially rectangular box shape whose upper surface is open. A first contact glass 111 and a second contact glass 112 are fit into the upper surface of the reading frame 110. The first contact glass 111 is used for reading document sheets automatically fed from the document conveying device 106. The second contact glass 112 is used for reading manually set document sheets.

A scanning mechanism 113 and an image pickup element 114 for optically reading document information of document sheets are accommodated in the reading frame 110. The scanning mechanism 113 includes a light source, a moving carriage, a reflection mirror, and other elements and is configured to guide light reflected from a document to the image pickup element 114. The image pickup element 114 converts the reflected light into an electrical signal.

The front, the right and left sides, and the bottom of the reading frame 110 are covered with a front cover 120, a left side cover 121, a right side cover (not illustrated), and a bottom cover 122. The left side cover 121 covers the left side of the reading frame 110 and is provided with a guiding portion 123 in its lower part. The guiding portion 123 extends inside the cavity paper output portion 103. The guiding portion 123 supports the downstream end of the second ejection tray 105 and includes an airflow path for use in sending air into the second ejection tray 105. The bottom cover 122 opposes the second ejection tray 105 and forms the upper surface of the cavity paper output portion 103.

The guiding portion 123 of the left side cover 121 is hollow and has an oblong rectangular shape. The guiding portion 123 has an opening communicating with a ventilation port 110B, which is described below, in its upper portion. The guiding portion 123 is provided with a guide rail 123A for supporting the left end of the second ejection tray 105 in attaching the second ejection tray 105. The guide rail 123A extends in the front and rear direction. The second ejection tray 105 has substantially the same configuration as that of the second paper output tray 5 in the first embodiment illustrated in FIG. 3, and the detailed description is omitted. The guide rail 123A includes an air-sending port 123B communicating with the inlet 42 in its central part. The guiding portion 123 includes an airflow path 123C therein. The airflow path 123C is formed between the air-sending port 123B and a bottom 110A of the reading frame 110.

A fan 115 for sending air into the reading frame 110 is positioned in the rear part of the image scanning portion 102. The fan 115 is arranged behind the location where the second contact glass 112 is arranged. The fan 115 sends outside air into the reading frame 110 and cools the scanning mechanism 113, which stops below the second contact glass 112 and reads an image, and other components. The bottom 110A of the reading frame 110 has the ventilation port 110B disposed in the vicinity of the left end. The ventilation port 110B is long in the front and rear direction and has a substantially rectangular shape. A part of cooling air sent into the reading frame 110 by the fan 115 flows along the airflow path 123C of the guiding portion 123 through the ventilation port 110B. The air is sent into the accommodation space 41 through the inlet 42 of the second ejection tray 105 and is discharged through the outlet 52.

According to an embodiment of the present disclosure, in the image forming apparatus such as the copier, the reading portion for reading document images and sheets with images formed thereon ejected to the ejection trays can be cooled by the single fan. Thus the cost of the apparatus can be reduced, and the space for arranging the fan can be decreased. Accordingly, the apparatus can be miniaturized.

In the above-described embodiments, the cases where the air-blowing device 43 or the fan 115 is positioned in the vicinity of the inlet 42 in the accommodation space 41 are described. In other different embodiments, the air-blowing device 43 or the fan 115 may also be positioned in the vicinity of the outlet 52 of the accommodation space 41.

In the present embodiments, the cases where the configuration of the present invention is applied to the color printer 1 and the color copier 100 are described. In other different embodiments, the configuration of the present invention is also applicable to image forming apparatuses, such as a monochrome printer, a monochrome copier, a facsimile machine, and a multifunction peripheral.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an image forming portion configured to form toner images and fix the toner images on sheets;

a first paper output tray including a first receiving portion on an upper surface thereof, the first receiving portion being configured to receive a sheet discharged through a paper ejection port with a fixed toner image thereon;

a second paper output tray positioned over the first receiving portion and including a second receiving portion on an upper surface thereof, and having a flat box shape, the second receiving portion configured to receive a sheet; and an air-blowing device configured to generate cooling air for cooling the sheet discharged through the paper ejection port, wherein the second paper output tray includes an accommodation space and a pair of partitions therein, the accommodation space accommodating the cooling air for cooling the sheet, the second paper output tray further includes an inlet for receiving the cooling air into the accommodation space at a side surface of a downstream side in a paper discharging direction and an outlet for discharging the cooling air from the accommodation space at a bottom surface near an end portion of an upstream side in the paper discharging direction, the pair of partitions is formed inside the second paper output tray, a distance between the pair of partitions becomes greater from the inlet of the second paper output tray toward the outlet of the second paper output tray, the accommodation space is formed between the pair of partitions and widens from the inlet of the second paper output tray toward the outlet of the second paper output tray in a horizontal direction perpendicular to the paper discharging direction, and the air-blowing device is connected to the inlet of the second paper output tray and blows the cooling air toward the inlet of the second paper output tray.

2. The image forming apparatus according to claim 1, wherein the outlet of the second paper output tray is configured to allow the cooling air to be discharged toward the paper ejection port through which the sheet is ejected to the first paper output tray.

3. The image forming apparatus according to claim 1, wherein the second paper output tray includes a rib on an upper surface thereof, the rib extending along a sheet ejection direction.

4. The image forming apparatus according to claim 1, comprising an image reading portion configured to optically read a document image, wherein the air-blowing device is located in the image reading portion.

* * * * *